US009128467B2

(12) United States Patent
Sugai

(10) Patent No.: US 9,128,467 B2
(45) Date of Patent: Sep. 8, 2015

(54) ELECTRONIC INSTRUMENT AND ELECTRONIC TIMEPIECE

(75) Inventor: Yoshinori Sugai, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 508 days.

(21) Appl. No.: 13/534,152

(22) Filed: Jun. 27, 2012

(65) Prior Publication Data

US 2013/0021879 A1 Jan. 24, 2013

(30) Foreign Application Priority Data

Jul. 21, 2011 (JP) ..... 2011-159990

(51) Int. Cl.
*G04G 19/08* (2006.01)
*G04C 10/00* (2006.01)
*G04C 10/02* (2006.01)

(52) U.S. Cl.
CPC ..... *G04C 10/02* (2013.01); *G04G 19/08* (2013.01); *G04C 10/00* (2013.01)

(58) Field of Classification Search
CPC ..... G04G 19/08; G04G 19/00; G04C 10/00; G04C 10/04
USPC ..... 368/203–204
See application file for complete search history.

(56) References Cited

U.S. PATENT DOCUMENTS

| | | | | |
|---|---|---|---|---|
| 4,926,881 | A * | 5/1990 | Ichinomiya et al. | 607/155 |
| 5,062,090 | A * | 10/1991 | Komiyama | 368/88 |
| 5,998,962 | A | 12/1999 | Akiya | 320/106 |
| 2003/0169642 | A1 * | 9/2003 | O'Neill et al. | 368/21 |
| 2006/0158963 | A1 * | 7/2006 | O'Neill et al. | 368/46 |
| 2008/0246437 | A1 * | 10/2008 | Kitahara | 320/134 |
| 2009/0016172 | A1 * | 1/2009 | Fujii et al. | 368/80 |

FOREIGN PATENT DOCUMENTS

| | | |
|---|---|---|
| JP | 07014601 | 1/1995 |
| JP | 2006331668 | 12/2006 |

* cited by examiner

*Primary Examiner* — Sean Kayes
(74) *Attorney, Agent, or Firm* — Adam & Wilks

(57) ABSTRACT

An electronic instrument has a power unit configured to allow insertion of a cell and to supply an electric power output from the inserted cell, a charging unit configured to charge the cell inserted in the power unit, and a voltage detecting unit configured to detect a voltage value of the cell inserted in the power unit. A cell type determining unit is configured to determine that the cell inserted in the power unit is a secondary cell as a rechargeable battery when the voltage value detected by the voltage detecting unit is a value equal to or lower than a predetermined threshold value and to determine that the cell inserted in the power unit is a primary cell as a non-rechargeable battery when the voltage value detected by the voltage detecting unit is larger than the predetermined threshold value.

18 Claims, 2 Drawing Sheets

ELECTRONIC INSTRUMENT AND ELECTRONIC TIMEPIECE

BACKGROUND OF THE INVENTION

1. Technical Field

The present invention relates to an electronic instrument and an electronic timepiece.

2. Description of the Related Art

A CTL1616, used as a secondary cell for a solar timepiece, has the same size as a primary cell (lithium cell) CR1616. Therefore, there arises a case where the CR1616 is inserted erroneously at the time of replacement of the cell of the solar timepiece or a case where the CR1616 is inserted because the CTL 1616 is not easily available. When the CR1616 is inserted in the solar timepiece which uses the CTL1616, heat generation of the cell may occur.

Therefore, a technique for discriminating the primary cell and the secondary cell is known. More specifically, a technique for discriminating the primary cell and the secondary cell by changing the shape of the secondary cell is known (see JP-A-7-14601, for example). Also, a technique for discriminating the primary cell and the secondary cell from the voltage difference after the usage for a predetermined period is known (see Japanese Patent No. 2990104, for example). A method of discriminating the primary cell and the secondary cell by adhering a seal on one of electrodes of the secondary cell is known (see JP-A-2006-331668, for example).

However, in the method of changing the shape of the secondary cell, there is a problem that a specific process is needed for changing the shape of the secondary cell. In the method of discriminating the primary cell and the secondary cell from a potential difference after the usage for the predetermined period, since it takes time until the discrimination is completed, and there is a problem in that the timepiece cannot be used immediately even a proper CTL1616 is inserted. In the method of adhering the seal on one of the electrodes of the secondary cell, there is a problem that a process of adhering the seal on the secondary cell is necessary.

SUMMARY

It is an aspect of the present application to provide an electronic instrument and an electronic timepiece which are capable of determining whether an inserted cell is a primary cell or a secondary cell immediately without applying a process on the secondary cell.

The application provides an electronic instrument including: a power unit configured to allow insertion of a cell and supply an electric power output from the inserted cell; a charging unit configured to charge the cell inserted in the power unit; a voltage detecting unit configured to detect a voltage value of the cell inserted in the power unit; and a cell type determining unit configured to determine that the cell inserted in the power unit is a secondary cell when the voltage value detected by the voltage detecting unit is a value equal to or lower than a predetermined threshold value and determine that the cell inserted in the power unit is a primary cell when the voltage value detected by the voltage detecting unit is larger than the predetermined threshold value.

Preferably, the cell type determining unit performs a process for abnormality which notifies that the primary cell is inserted in the power unit when the cell inserted in the power unit is determined to be the primary cell.

Preferably, the electronic instrument includes a display unit, and the cell type determining unit causes the display unit to display an error message as the process for abnormality.

Preferably, the electronic instrument includes a display unit, and the cell type determining unit turns OFF the display on the display unit as the process for abnormality.

Preferably, the electronic instrument includes an input unit configured to accept an input, and the cell type determining unit cancels the input accepted by the input unit as the process for abnormality.

Preferably, the primary cell is a CR1616, the secondary cell is a CTL1616, and the cell allowed to be inserted in the power unit is the cell having the same shape as the CTL1616.

The application also provides an electronic timepiece including: a power unit configured to allow insertion of a cell and supply an electric power output from the inserted cell; a charging unit configured to charge the cell inserted into the power unit; a voltage detecting unit configured to detect a voltage value of the cell inserted into the power unit; and a cell type determining unit configured to determine that the cell inserted into the power unit is a secondary cell when the voltage value detected by the voltage detecting unit is a value equal to or lower than a predetermined threshold value and determine that the cell inserted into the power unit is a primary cell when the voltage value detected by the voltage detecting unit is larger than the predetermined threshold value.

According to the application, the power unit allows insertion of a cell therein, and supplies an electric power output from the inserted cell. Also, the charging unit charges the cell inserted in the power unit. The voltage detecting unit detects the voltage value of the cell inserted in the power unit. The cell type determining unit determines that the cell inserted into the power unit is a secondary cell when the voltage value detected by the voltage detecting unit is a value equal to or lower than a predetermined threshold value and determines that the cell inserted into the power unit is a primary cell when the voltage value detected by the voltage detecting unit is larger than the predetermined threshold value. Accordingly, the type of the cell inserted in the power unit may be determined by detecting the voltage value of the cell inserted in the power unit. Therefore, whether or not the inserted cell is the primary cell or the secondary cell may be determined immediately without applying a process on the secondary cell.

DETAILED DESCRIPTION OF THE PREFERRED EMBODIMENTS

Figure 1:
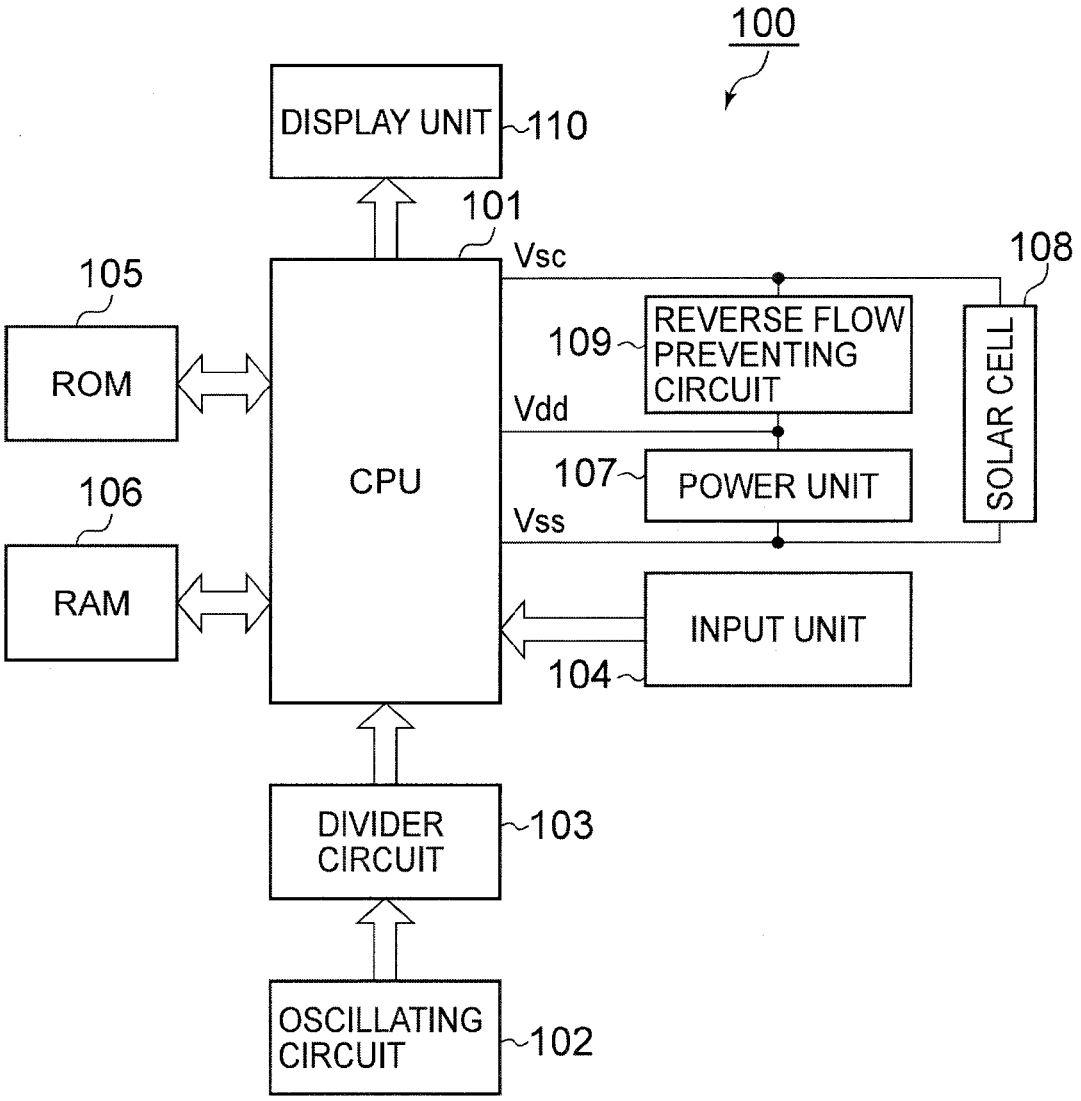
FIG. 1 is a block diagram showing a configuration of an electronic timepiece according to an embodiment of the invention.

Referring now to the drawings, an embodiment of the invention will be described. In the embodiment, an example of an electronic timepiece provided with a solar cell will be described as an example of an electronic instrument. FIG. 1 is a block diagram showing a configuration of the electronic timepiece according to the embodiment. In an illustrated example, an electronic timepiece 100 includes a CPU 101 (voltage detecting unit, cell type determining unit), an oscillating circuit 102, a divider circuit 103, an input unit 104, a ROM (Read Only memory) 105, a RAM (Random Access Memory) 106, a power unit 107, a solar cell 108 (charging unit), a reverse flow preventing circuit 109, and a display unit 110.

The CPU 101 performs control of respective portions provided in the electronic timepiece 100. The CPU 101 is configured to detect the voltage of the cell inserted in the power unit 107. The CPU 101 determines the variety of the cell inserted in the power unit 107. The oscillating circuit 102 outputs a signal having a predetermined frequency. The divider circuit 103 divides the output signal from the oscillating circuit 102 by a predetermined dividing ratio and outputs a reference clock signal for the CPU 101 or a clock signal for time keeping. The input unit 104 includes a switch which allows operation from the outside, and accepts an input. The ROM 105 stores a program to be executed by the CPU 101 in advance. The RAM 106 stores data used by the electronic timepiece 100.

The power unit 107 includes a cell box which allows insertion of a secondary cell CTL1616, and supplies an electric power of the CTL1616 inserted in the cell box to respective portions provided in the electronic timepiece 100. The CTL1616 to be inserted in the power unit 107 is replaceable. The shapes of the CTL1616 and a CR1616, which is a primary cell (lithium cell) are the same. Therefore, inserting the CR1616 erroneously at the time of replacement of the CTL1616 inserted in the power unit 107 or inserting the CR1616 because the CTL1616 is not easily available may occur. A maximum voltage output by the CTL1616 is approximately 2.6V. An initial voltage of the CR1616 is 3V or higher.

When the CR1616 is inserted in the power unit 107 instead of the CTL1616, the CR1616 may generate heat since the CR1616 is the primary cell. Therefore, in the embodiment, the electronic timepiece 100 performs a process of determination of the variety of the cell inserted in the power unit 107 at the time of putting a power ON or at the time of resetting, and changes the process to be performed on the basis of the result of determination. Detailed procedure of a cell type determining process will be described later.

The solar cell 108 generates an electric power according to the intensity of received light, and charges the CTL1616 inserted in the power unit 107. The reverse flow preventing circuit 109 is a circuit configured to control an electric current so as not to flow from the power unit 107 to the solar cell 108. The display unit 110 is, for example, a liquid crystal display, and displays information such as time of day.

Figure 2:
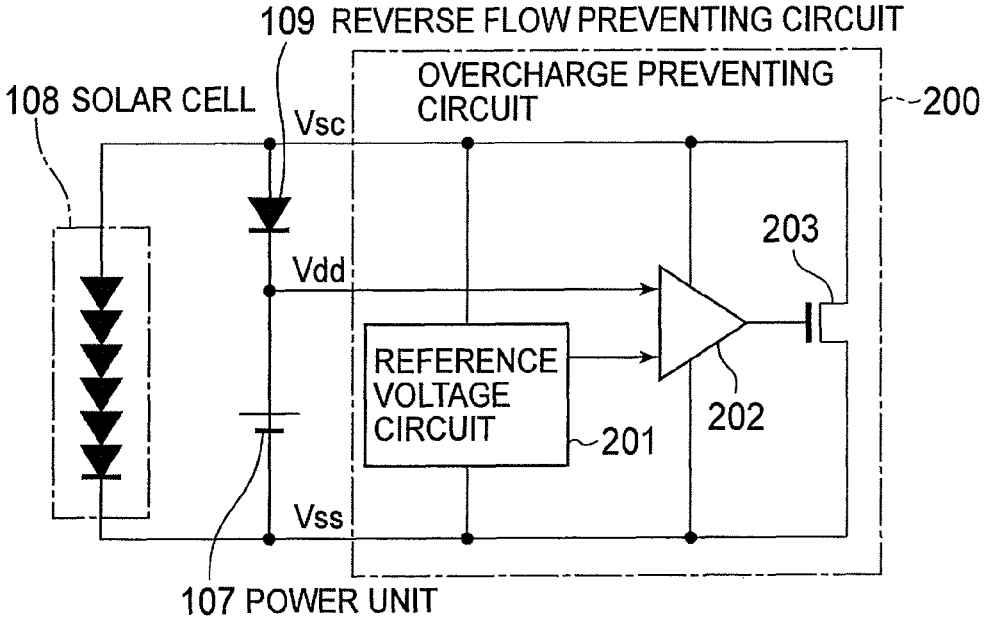
FIG. 2 is a circuit drawing showing a circuit configuration including a power unit, a solar cell, a reverse flow preventing circuit, and an overcharge preventing circuit according to the embodiment.

Subsequently, a circuit configuration of the electronic timepiece 100 including the power unit 107, the solar cell 108, the reverse flow preventing circuit 109, and an overcharge preventing circuit 200 will be described. FIG. 2 is a circuit drawing showing the circuit configuration of the electronic timepiece 100 including the power unit 107, the solar cell 108, the reverse flow preventing circuit 109, and the overcharge preventing circuit 200 in the embodiment. The overcharge preventing circuit 200 is part of the CPU 101. The overcharge preventing circuit 200 includes a reference voltage circuit 201, a comparator unit 202, and a NMOS transistor 203.

In the illustrated example, an anode terminal of the solar cell 108 is connected to a power line Vsc, and a cathode terminal thereof is connected to a power line Vss. An anode terminal of the power unit 107 is connected to a power line Vdd, and a cathode terminal thereof is connected to the power line Vss. The reverse flow preventing circuit 109 is a diode element, and an anode terminal thereof is connected to the power line Vsc and a cathode terminal thereof is connected to the power line Vdd. In this configuration, the electric current is prevented from flowing from the power unit 107 to the solar cell 108.

One end of an input terminal of the comparator unit 202 is connected to the power line Vdd, and the other end thereof is connected to the reference voltage circuit 201. An output terminal of the comparator unit 202 is connected to a gate terminal of the NMOS transistor 203. A source terminal of the NMOS transistor 203 is connected to the power line Vss, and a drain terminal thereof is connected to the power line Vsc.

The reference voltage circuit 201 inputs a reference voltage to the comparator unit 202. The reference voltage is, for example, a voltage of 2.6V which is output when the CTL1616 inserted in the power unit 107 is full charged. The comparator unit 202 compares the voltage of the power line Vdd with the reference voltage, and outputs a voltage from the output terminal when the voltage of the power line Vdd is a voltage equal to or higher than the reference voltage. Accordingly, when the voltage of the power line Vdd is a voltage equal to or higher than the reference voltage, that is, when the CTL1616 inserted in the power unit 107 is fully charged, an electric current generated by the solar cell 108 does not flow through the power unit 107, but flows through the NMOS transistor 203. Therefore, overcharge of the CTL1616 inserted in the power unit 107 can be prevented.

Figure 3:
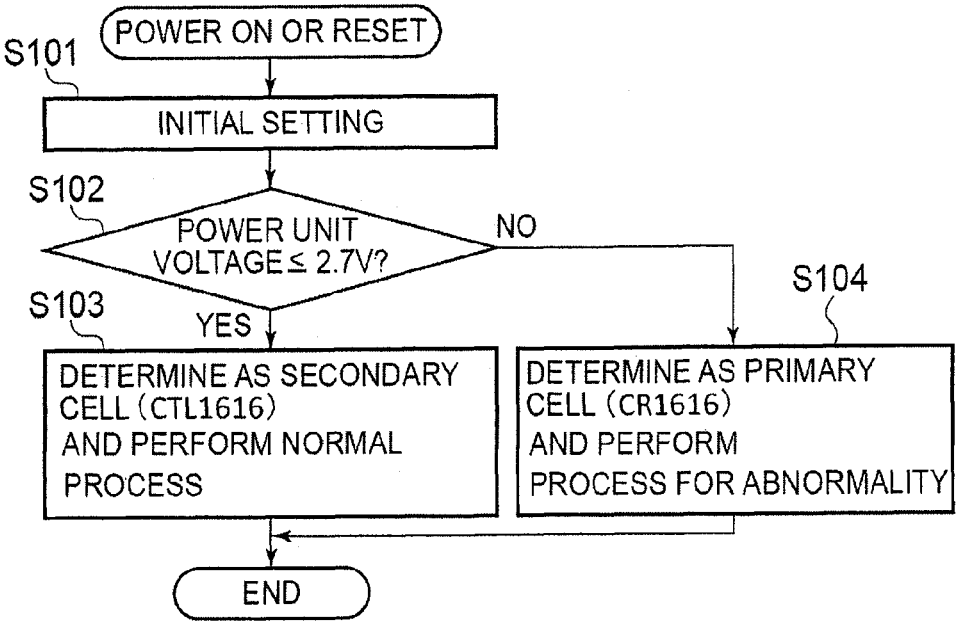
FIG. 3 is a flowchart showing a process procedure of a cell type determining process for the electronic timepiece according to the embodiment.

Subsequently, the cell type determining process for the electronic timepiece 100 according to the embodiment will be described. FIG. 3 is a flowchart showing a process procedure of the cell type determining process for the electronic timepiece 100 according to the embodiment. The electronic timepiece 100 performs the cell type determining process when the power is turned ON or at the time of resetting.

(Step S101) The CPU 101 performs an initial setting process. Subsequently, the procedure goes to the process in Step S102. For example, in the initial setting process, the CPU 101 clears the RAM 106, and time of day and a calendar are set to default values (for example, January 1st, 2011, 0:00).

(Step S102) The CPU 101 detects the voltage output from the power unit 107, and determines whether or not the voltage output from the power unit 107 is a voltage equal to or lower than 2.7V (whether or not it is equal to or lower than the maximum output voltage value of the secondary cell). The procedure goes to a process in Step S103 when the CPU 101 determines that the voltage output from the power unit 107 is a voltage equal to or lower than 2.7V, and goes to a process in Step S104 in other cases.

(Step S103) The CPU 101 determines that the cell inserted in the power unit 107 is the CTL1616 (secondary cell), and starts a normal time keeping process (normal process). Subsequently, the cell type determining process is ended.

(Step S104) The CPU 101 determines that the cell inserted in the power unit 107 is the CR1616 (primary cell), and starts a process for abnormality. Subsequently, the cell type determining process is ended. For example, in the process for abnormality, the CPU 101 displays an error message on the display unit 110, turns OFF (extinction) of the display on the display unit 110, or cancels out the input of the input unit 104, and notifies a user that the CR1616 is inserted. The error message may be, for example, "ERROR" or "primary cell is inserted".

As described above, in the embodiment, the CPU 101 detects the voltage output from the power unit 107 at the times when the power of the electronic timepiece 100 is turned ON or the electronic timepiece 100 is reset. Then, the CPU 101 determines whether the cell inserted in the power unit 107 is the secondary cell or the primary cell by determining whether or not the voltage output from the power unit 107 is a voltage equal to or lower than the maximum output voltage value of the secondary cell.

For example, when the secondary cell is the CTL1616 and the primary cell is the CR1616, the maximum voltage output from the CTL1616 is approximately 2.6V and the initial voltage of the CR1616 is 3V or higher. Therefore, when the CPU 101 determines that the voltage output from the power unit 107 is a voltage equal to or lower than 2.6V, the CPU 101 determines that the cell inserted in the power unit 107 is the CTL1616. When the CPU 101 determines that the voltage output from the power unit 107 is higher than 2.6V, the CPU 101 determines that the cell inserted in the power unit 107 is the CR1616.

When the CPU 101 determines that the voltage output from the power unit 107 is a voltage equal to or lower than the maximum output voltage value of the secondary cell, that is, when the the CPU 101 determines that the cell inserted in the power unit 107 is the secondary cell, the CPU 101 performs the normal process. When the CPU 101 determines that the voltage output from the power unit 107 is higher than the maximum output voltage value of the secondary cell, that is, when the CPU 101 determines that the cell inserted in the power unit 107 is the primary cell, the CPU 101 performs the process for abnormality.

Therefore, the electronic timepiece 100 is configured to be capable of determining whether the cell inserted in the power unit 107 is the primary cell or the secondary cell without applying a process on the secondary cell even when the primary cell and the secondary cell have the same shape. The electronic timepiece 100 is capable of notifying the result of determination of whether the cell inserted in the power unit 107 is the primary cell or the secondary cell to the user.

The entire or part of the functions of the respective portions provided in the electronic timepiece 100 in the embodiment described above may be realized by recording a program for realizing these functions in a computer readable recording medium and causing a computer system to read the program recorded in the recording medium and execute the program. The term "computer system" described here includes hardware such as OS or peripheral equipment.

The term "computer readable recording medium" means portable media such as flexible disks, magneto-optic disks, ROMs, and CD-ROMs, and memory devices such as hard disk integrated in the computer system. Also, the term "computer readable recording medium" may include those which hold the program dynamically for a short time like networks such as internet, or communication lines used for transmitting the program via a communication network such as telephone lines, and those which hold the program for a certain period such as a volatile memory in the interior of the computer system which becomes a server or a client in that case. The above-described program may be those which realize part of the above-described functions, and may be those which can realize the above-described functions in combination with the program already recorded in the computer system.

Although the embodiment of the invention has been described thus far, the invention is not limited to the embodiments shown above, and various modifications may be made without departing the scope of the invention.

For example, in the embodiment described above, the digital timepiece has been described as an example of the electronic timepiece. However, the invention is not limited thereto, and an analogue timepiece is also applicable. In the case of the analogue timepiece, as the process for abnormality, the fact that the primary cell (CR1616) is inserted may be notified to the user by turning an hour hand or a minute hand in the reverse direction.

What is claimed is:

1. An electronic instrument comprising:

a power unit configured to allow insertion of a cell and to supply an electric power output from the inserted cell;

a charging unit configured to charge the cell inserted in the power unit;

a voltage detecting unit configured to detect a voltage value of the cell inserted in the power unit; and a cell type determining unit configured to determine that the cell inserted in the power unit is a secondary cell as a rechargeable battery when the voltage value detected by the voltage detecting unit is a value equal to or lower than a predetermined threshold value and to determine that the cell inserted in the power unit is a primary cell as a non-rechargeable battery when the voltage value detected by the voltage detecting unit is larger than the predetermined threshold value.

2. The electronic instrument according to claim 1, wherein the cell type determining unit performs a process for abnormality which notifies that the primary cell is inserted in the power unit when the cell inserted in the power unit is determined to be the primary cell.

3. The electronic instrument according to claim 2, further comprising:

a display unit;

wherein the cell type determining unit causes the display unit to display an error message as the process for abnormality.

4. The electronic instrument according to claim 3, wherein the primary cell is a CR1616 battery, the secondary cell is a CTL1616 battery, and the cell allowed to be inserted in the power unit is a cell having the same shape as that of the CTL1616 battery.

5. The electronic instrument according to claim 2, further comprising:

a display unit;

wherein the cell type determining unit turns OFF a display on the display unit as the process for abnormality.

6. The electronic instrument according to claim 5, wherein the primary cell is a CR1616 battery, the secondary cell is a CTL1616 battery, and the cell allowed to be inserted in the power unit is a cell having the same shape as that of the CTL1616 battery.

7. The electronic instrument according to claim 2, further comprising:

an input unit configured to accept an input;

wherein the cell type determining unit cancels the input accepted by the input unit as the process for abnormality.

8. The electronic instrument according to claim 7, wherein the primary cell is a CR1616 battery, the secondary cell is a CTL1616 battery, and the cell allowed to be inserted in the power unit is a cell having the same shape as that of the CTL1616 battery.

9. The electronic instrument according to claim 2, wherein the primary cell is a CR1616 battery, the secondary cell is a CTL1616 battery, and the cell allowed to be inserted in the power unit is a cell having the same shape as that of the CTL1616 battery.

10. The electronic instrument according to claim 1, wherein the primary cell is a CR1616 battery, the secondary cell is a CTL1616 battery, and the cell allowed to be inserted in the power unit is a cell having the same shape as that of the CTL1616 battery.

11. The electronic instrument according to claim 1, wherein the cell type determining unit performs notification of a result of the determination as to whether the cell inserted in the power unit is the primary cell or the secondary cell.

12. In an electronic timepiece having a power unit configured to allow insertion of a cell and to supply an electric power output from the inserted cell and a charging unit configured to charge the cell inserted into the power unit, a central processing unit (CPU) comprising:

a voltage detecting unit configured to detect a voltage value of the cell inserted into the power unit; and a cell type determining unit configured to determine that the cell inserted in the power unit is a secondary cell as a rechargeable battery when the voltage value detected by the voltage detecting unit is a value equal to or lower than a predetermined threshold value and to determine that the cell inserted in the power unit is a primary cell as a non-rechargeable battery when the voltage value detected by the voltage detecting unit is larger than the predetermined threshold value.

13. The electronic timepiece according to claim 12, wherein the cell type determining unit performs notification of a result of the determination as to whether the cell inserted in the power unit is the primary cell or the secondary cell.

14. The electronic timepiece according to claim 13, wherein the notification comprises an indication of an abnormality when the cell type determining unit determines that the cell inserted in the power unit is the primary cell.

15. The electronic timepiece according to claim 14, further comprising a display unit; and wherein the cell type determining unit causes the display unit to display an error message as the indication of abnormality.

16. The electronic timepiece according to claim 14, further comprising a display unit having a display; and wherein the indication of abnormality comprises the display of the display unit being turned OFF by the cell type determining unit.

17. The electronic timepiece according to claim 14, further comprising an input unit for accepting an input; and wherein the indication of abnormality comprises an input accepted by the input unit being canceled by the cell type determining unit.

18. The electronic timepiece according to claim 12, wherein the primary cell is a CR1616 battery and the secondary cell is a CTL1616 battery having the same shape as that of the CR1616 battery.

* * * * *